US006734609B2

(12) United States Patent
Weon

(10) Patent No.: US 6,734,609 B2
(45) Date of Patent: May 11, 2004

(54) CATHODE IN CRT AND METHOD FOR FABRICATING THE SAME

(75) Inventor: Byung Mook Weon, Kumi-shi (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/125,425

(22) Filed: Apr. 19, 2002

(65) Prior Publication Data

US 2002/0180327 A1 Dec. 5, 2002

(30) Foreign Application Priority Data

Jun. 1, 2001 (KR) ..... P 2001-30859

(51) Int. Cl.[7] ..... H01J 29/46

(52) U.S. Cl. ..... 313/310; 313/446; 313/346 DC

(58) Field of Search ..... 313/446, 310, 313/346 DC, 351, 309, 346 R; 445/46, 51

(56) References Cited

U.S. PATENT DOCUMENTS 4,370,588 A * 1/1983 Takahashi et al. ..... 313/446

* cited by examiner

*Primary Examiner*—Nimeshkumar D. Patel
*Assistant Examiner*—Sharlene Leurig
(74) *Attorney, Agent, or Firm*—Fleshner & Kim, LLP

(57) ABSTRACT

The present invention relates to a cathode in a cathode ray tube which can shorten a picture presentation time lag and reduce power consumption. The cathode includes an emission layer at an upper part of the cathode and a sleeve for inserting a heater therein, wherein the sleeve contains a blackened material, and has a porous surface.

18 Claims, 5 Drawing Sheets

CATHODE IN CRT AND METHOD FOR FABRICATING THE SAME

BACKGROUND OF THE INVENTION

1. Field of the Invention

The present invention relates to a cathode ray tube, and more particularly, to a cathode in a cathode ray tube (CRT).

2. Background of the Related Art

Referring to FIG. 1, in general, the CRT is provided with a panel 1 having a coat of fluorescent film, a shadow mask 4 fitted to an inside of the panel, and a funnel 2 having a neck tube 3 of a funnel form in rear. There is an electron gun 5 built in the neck tube 3 having a cathode 10 therein. Thermal electrons from the cathode 10 are focused to form an electron beam, which is controlled by a magnetic field from a deflection yoke 7 around an outer part of the neck part. The color for the CRT is then selected at the shadow mask 4 for illumination by the electron beam, which lands on a preset location of the fluorescent film screen and causes the fluorescent film to emit a light and display a picture.

Referring to FIG. 2, the cathode 10 is provided with an emission layer 12, a base metal 14, a heater 16, a sleeve 20, and a holder 18. The emission layer 12 is primarily made of an alkali earth metal carbonate, such as barium carbonate $BaCO_3$, strontium carbonate $SrCO_3$ or calcium carbonate $CaCO_3$ The emission layer 12 is usually in an acicular form of fine powder with a long axis of approximately 8 $\mu$m, and a short axis of approximately 0.5 $\mu$m which can be spray coated on the base metal 14. The base metal 14 is primarily made of nickel with a small amount of a reducing agent, such as magnesium or silicon, for promoting reduction of the emission layer 12 and supporting the emission layer 12.

The heater 16 has a resistance wire primarily composed of tungsten (W) with a coat of alumina ($Al_2O_3$) thereon as an insulating layer. For generating heat, the sleeve 20 is primarily composed of Ni—Cr. The holder 18, which supports the base metal 14 and transmits heat from the heater 16 to the base metal 14, is primarily composed of an alloy of nickel for holding the sleeve 20.

The cathode in the CRT emits thermal electrons to form an electron beam. Meanwhile, the heat from the heater 16 is transmitted to the emission layer 12 by conduction and radiation through the sleeve 20.

The picture presentation time lag is the amount of time required from the application of power to the heater 16 to the eventual presentation of a picture on the screen. This lag depends upon the heater power consumption and thus the heater power required for regular operation of the CRT. It is important that the picture presentation time lag is made shorter while the heater power consumption is reduced in order to optimize the efficiency of the display. In other words, minimizing the picture presentation time lag can be achieved by transmitting the heat from the heater to the emission layer within a minimal time period to therefore minimize the heat loss at the heater 16.

Therefore, in order to minimize the heat loss, a reductive heat treated sleeve 20 for reducing a heat loss from radiation is often employed. However, the use of such a sleeve 20 has often led to a long picture presentation time lag as the sleeve has a long time period of heat storage during the heat conduction.

FIG. 2A illustrates a related art method for reducing heat loss, which includes blackening only an inside surface 20*a* of the sleeve 20, as described in JP laid open patent No. 07182965 JP A, and No. 09139171 JP A. This method employs a nickel alloy containing approximately 18–20 wt % of chrome, and a reductive material, for blackening a cathode sleeve at approximately 1050° C. for 1 to 2 minutes in a moisturized hydrogen atmosphere to form chrome oxide. Then, the blackened cathode sleeve is heat treated in a dried hydrogen atmosphere to reduce an outer wall of the oxidized cathode sleeve. These blackening/reducing treatments, as illustrated in FIG. 2B, provide the inside surface 20*a* of the sleeve with little surface porosity and approximately 32 wt % chrome and a radiation ratio of approximately 0.65 to shorten the picture presentation time lag. The outside surface 20*b* has approximately 26 wt % of chrome and an approximate 0.32 radiation ratio, thereby serving to reduce the heat loss of the heater.

However, the foregoing method is expensive as the fabrication process is complicated due to the two blackening/reducing heat treatments. Additionally, second reduction heat treatment of this related art fabrication process causes the heat radiation ratio of the inside surface 20*a* of the sleeve of the cathode to possibly be reduced. The fabrication method also has difficulty in controlling degrees of the blackening/reducing the inside and outside surfaces of the cathode sleeve in the blackening/reducing heat treatments.

The above references are incorporated by reference herein where appropriate for appropriate teachings of additional or alternative details, features and/or technical background.

SUMMARY OF THE INVENTION

An object of the invention is to solve at least the above problems and/or disadvantages and to provide at least the advantages described hereinafter.

Accordingly, the present invention is directed to a cathode in a CRT that substantially obviates one or more of the problems due to limitations and disadvantages of the related art.

An object of the present invention is to provide a cathode in a CRT which can reduce a heater power consumption and shorten a picture presentation time lag.

Another object of the present invention is to provide a cathode in a cathode ray tube which includes an emission layer at an upper part of the cathode, and a sleeve for inserting a heater therein, wherein the sleeve contains a blackened material that has a porous surface.

Another object of the present invention is to provide a cathode in a CRT including, an emission layer at an upper part of the cathode, a sleeve on side portions of the cathode, and a heater within the cathode, wherein the sleeve has a porous surface formed by heat treating a metal alloy in a moisturized hydrogen atmosphere to blacken the metal alloy, and vaporizing the blackened metal alloy to form the porous surface.

Another object of the present invention is to provide a method of forming a cathode in a cathode ray tube including forming a cathode which include an emission layer, a heater and a sleeve, then heat treating the sleeve, and vaporizing the sleeve to form pores in the surface of the sleeve.

Additional advantages, objects, and features of the invention will be set forth in part in the description which follows and in part will become apparent to those having ordinary skill in the art upon examination of the following or may be learned from practice of the invention. The objects and advantages of the invention may be realized and attained as particularly pointed out in the appended claims.

BRIEF DESCRIPTION OF THE DRAWINGS

The invention will be described in detail with reference to the following drawings, in which like reference numerals refer to like elements, and wherein.

DETAILED DESCRIPTION OF THE PREFERRED EMBODIMENTS

Figure 3A:
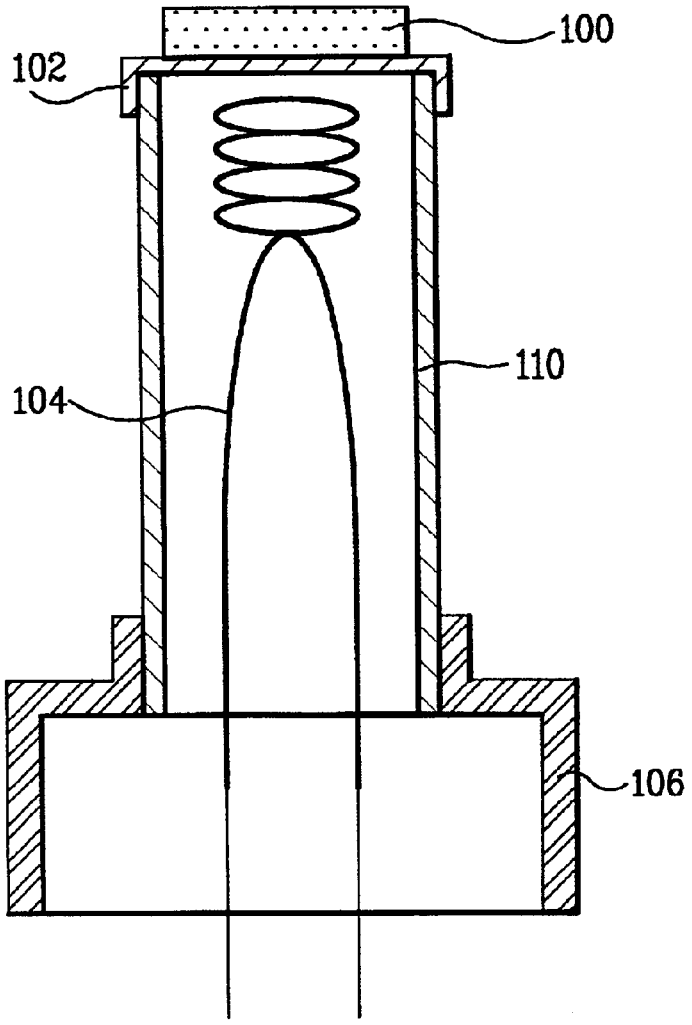
FIG. 3A illustrates a section of a cathode in a CRT in accordance with a preferred embodiment of the present invention.
Figure 3B:
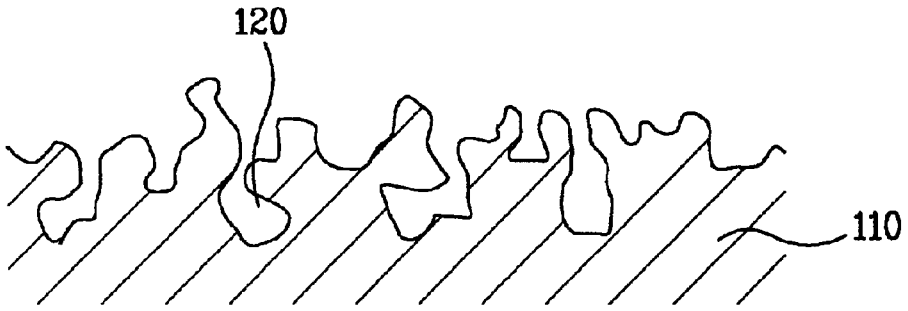
FIG. 3B illustrates a section of a cathode sleeve in a CRT in accordance with a preferred embodiment of the present invention.

Referring to FIG. 3A, a cathode in a CRT of the present invention has an emission layer 100 formed at an upper part of the cathode, and a sleeve 110 having a heater 104 inserted therein, where the sleeve 110 contains a blackening material and has a porous surface. That is, as shown in FIG. 3B, the sleeve 110 of the cathode in a CRT of the present invention contains a blackened material with high radiation ratio and a porous surface 120 with an increased surface area. It is preferable that the porosity of the porous surface of the sleeve is 10–50%.

Heat from a heater inserted inside a sleeve of a cathode of a CRT is transferred to an emission layer by radiation and conduction. The transfer by radiation is according to the following Stefan-Boltzmann equation.

$$Q(W)=A_1\epsilon\sigma(T_1^4-T_a^4) \quad (1),$$

where, $A_1$ denotes a radiation area, $\epsilon$ denotes a radiation ratio, $\sigma$ denotes a Stefan-Boltzmann constant, $T_1$ denotes an absolute temperature of a radiator, and $T_a$ denotes an absolute temperature of an absorber.

Heat conduction can be expressed by the following equation (2).

$$Q(W)=kA_2\frac{(Ti-To)}{L} \quad (2)$$

where, k denotes a constant, $A_2$ denotes a heat conduction area, L denotes a heat conduction length, Ti denotes an input absolute temperature, and To denotes an output absolute temperature.

As can be known from equations (1) and (2), the heat transfer is proportional to the radiation area $A_1$ and the conduction area $A_2$. Therefore, the present invention suggests increasing a heat transfer area of the sleeve in heat transfer from a heater to an emission layer for shortening a picture presentation time lag and reducing a power consumption of the heater.

Figure 4:
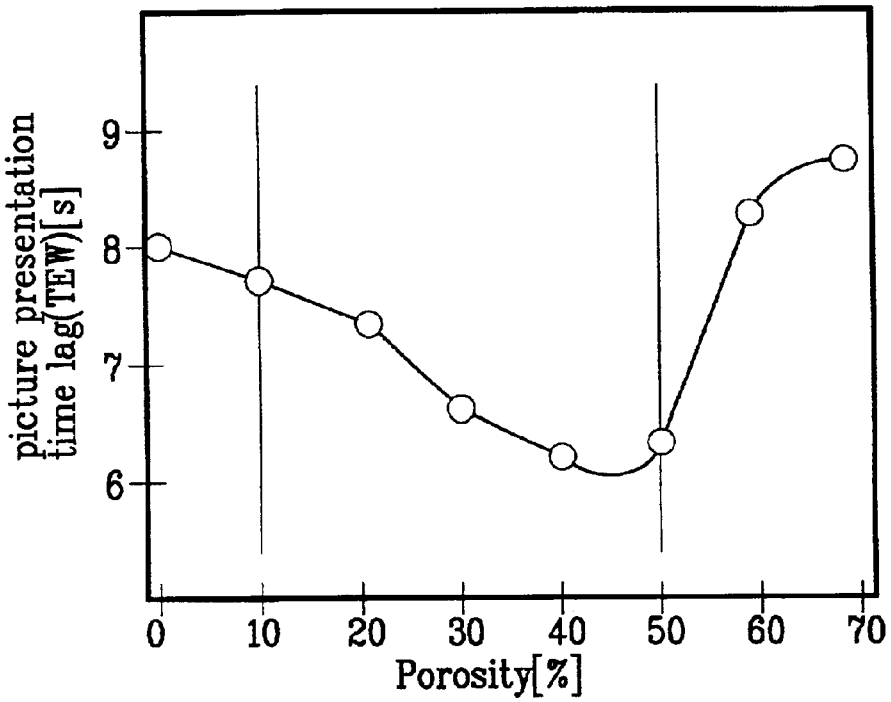
FIG. 4 illustrates a graph showing a porosity of a sleeve surface vs. a picture presentation time lag of a CRT for a preferred embodiment of the present invention.
Figure 5:
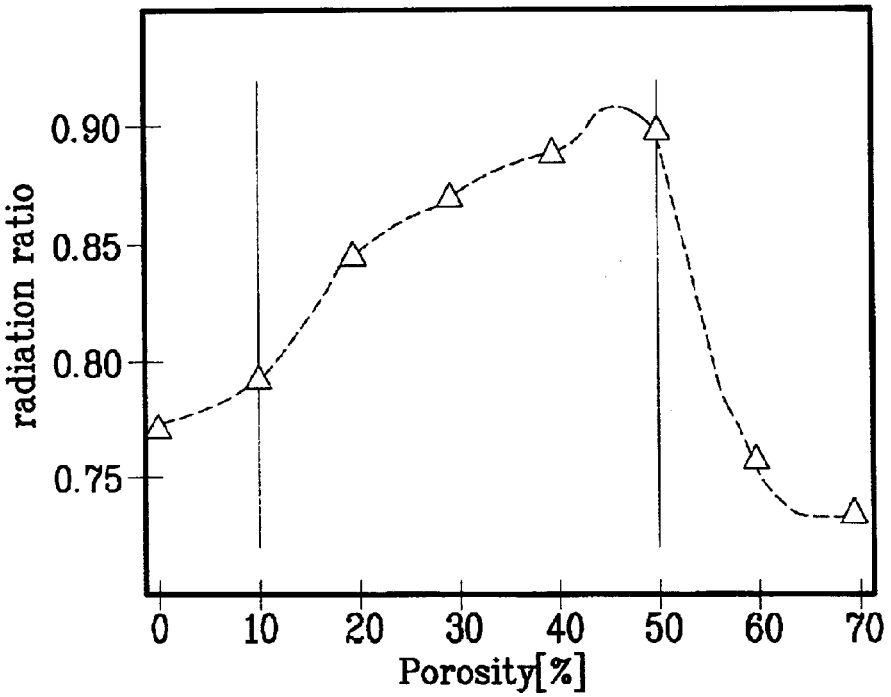
FIG. 5 illustrates a graph showing a porosity of a sleeve surface vs. a radiation ratio of a heat from a heater for a preferred embodiment of the present invention; and, FIG. 6 illustrates a graph showing a porosity of a sleeve surface vs. temperature and time of heat treatment during sleeve fabrication for a preferred embodiment of the present invention.

FIGS. 4 and 5 illustrate graphs showing a porosity of the sleeve surface vs. a picture presentation time lag of the CRT in FIG. 4, and vs. a radiation ratio in FIG. 5. FIG. 4 illustrates that the picture presentation time lag is shortened from approximately 8 seconds with no porosity to approximately 6 seconds with a porosity of about 45%. FIG. 5 illustrates that the radiation ratio is increased from approximately 0.75 for a CRT with zero porosity to approximately 0.90 when the porosity is in a range of approximately 50%. Further, FIGS. 4 and 5 illustrate that the radiation ratio drops and the picture presentation time lag is prolonged if the porosity is over 50%.

The pores 120 are cavities in a solid, and the porosity P is defined as ratio of a volume of the pores to a total volume of the solid, as the following equation (3).

$$P=\frac{V-V_a}{V}\times 100 \quad (3),$$

where, P denotes a porosity, V denotes the total volume of solid including the pores, and $V_a$ denotes the volume of the solid only, exclusive of the pores. It is preferable that a surface roughness of the porous sleeve is 0.5–5.0 $\mu$m. Though an increase of the surface roughness implies an increase in surface area, when the surface roughness is much greater than about 0.5 $\mu$m, the picture presentation time lag can be prolonged.

In one preferred embodiment of the invention, the porous surface is formed by vaporizing chrome oxide ($Cr_2O_3$) and blackening the chrome (Cr) as the chrome is oxidized. Of course, other materials could be used. Additionally, it is also preferable for a base metal 102, which can promote the reduction of the emission layer 100, to be formed between the sleeve 110 and the emission layer, and a holder 106 for supporting the sleeve 1 10 to be formed.

The present invention also provides a method for fabricating a cathode in a CRT having an emission layer 100 at an upper part, and a sleeve 110 having a heater 104 inserted therein. In this method, a sleeve 110 is formed to have a porous surface by blackening a metal alloy by heat treatment in a moisturized hydrogen atmosphere and vaporizing the blackened metal alloy.

Figure 1:
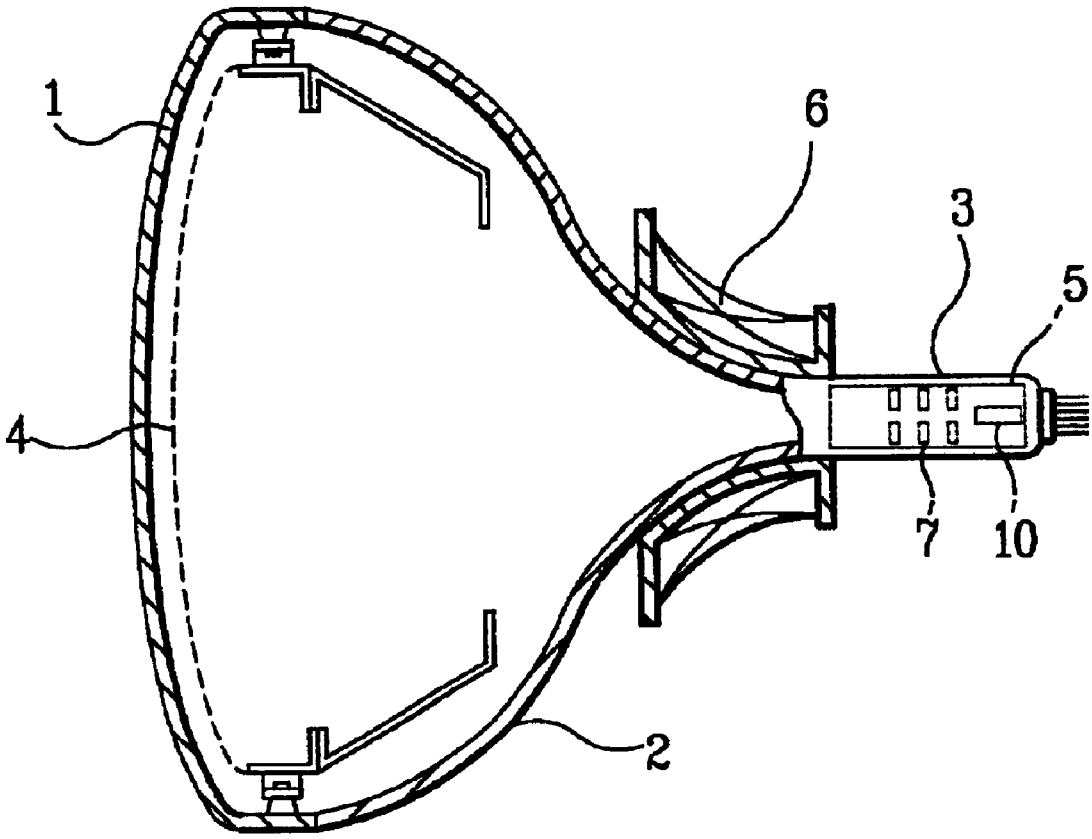
FIG.1 Related Art
FIG. 1 illustrates a related art cathode ray tube (CRT), schematically.
Figure 2A:
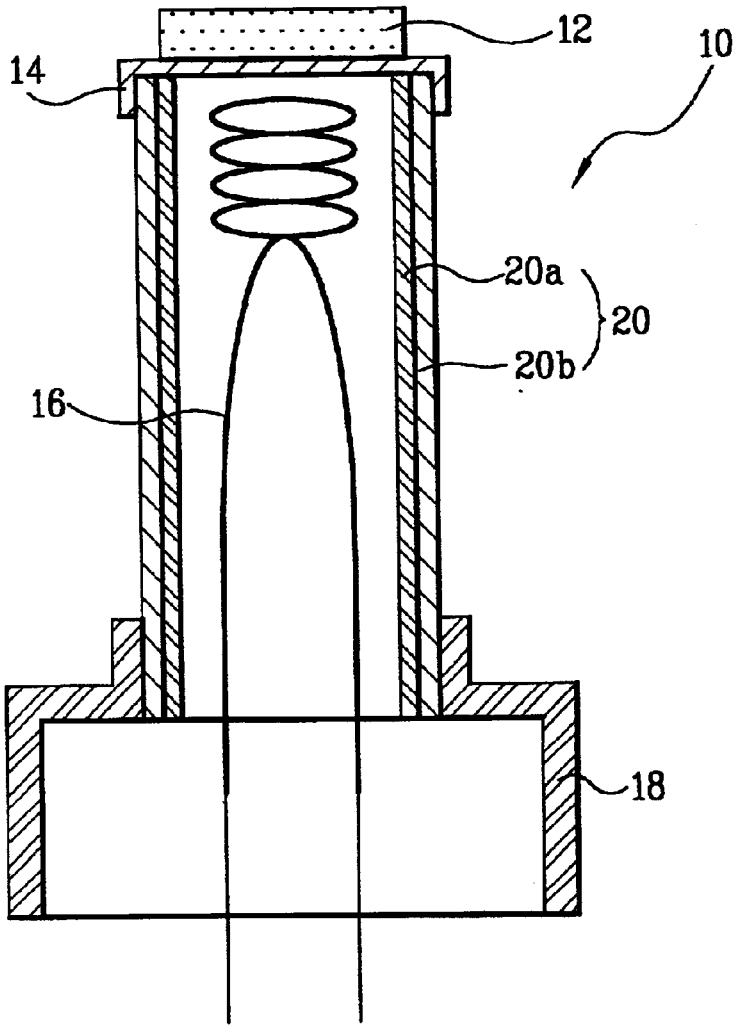
FIG.2A Related Art
FIG. 2A illustrates a section of a related art cathode in a CRT.
Figure 2B:
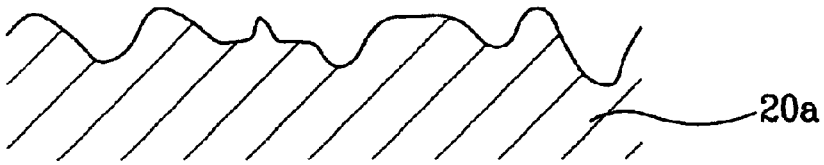
FIG.2B Related Art
FIG. 2B illustrates a section of a related art cathode sleeve in a CRT.

As explained, it is preferable that the porosity of the porous surface of the sleeve 110 is 10–50%. Therefore, the conditions of the heat treatment should be adjusted appropriately for making the porosity to be within the above range. As expressed in formula (4) below, preferably the sleeve would have an increased surface porosity, as shown in FIG. 3B compared to the related art sleeve as shown in FIG. 2B, by diffusing Cr in a Ni—Cr alloy into a surface of the sleeve by heat treatment in a moisturized hydrogen atmosphere, oxidizing Cr into $Cr_2O_3$ to blacken the Cr, and vaporizing the oxidized chrome $Cr_2O_3$ to form pores 120 in the surface of the sleeve.

$$2Cr+3H_2O\rightarrow Cr_2O_3(\uparrow)+3H_2(\uparrow) \quad (4).$$

Figure 6:
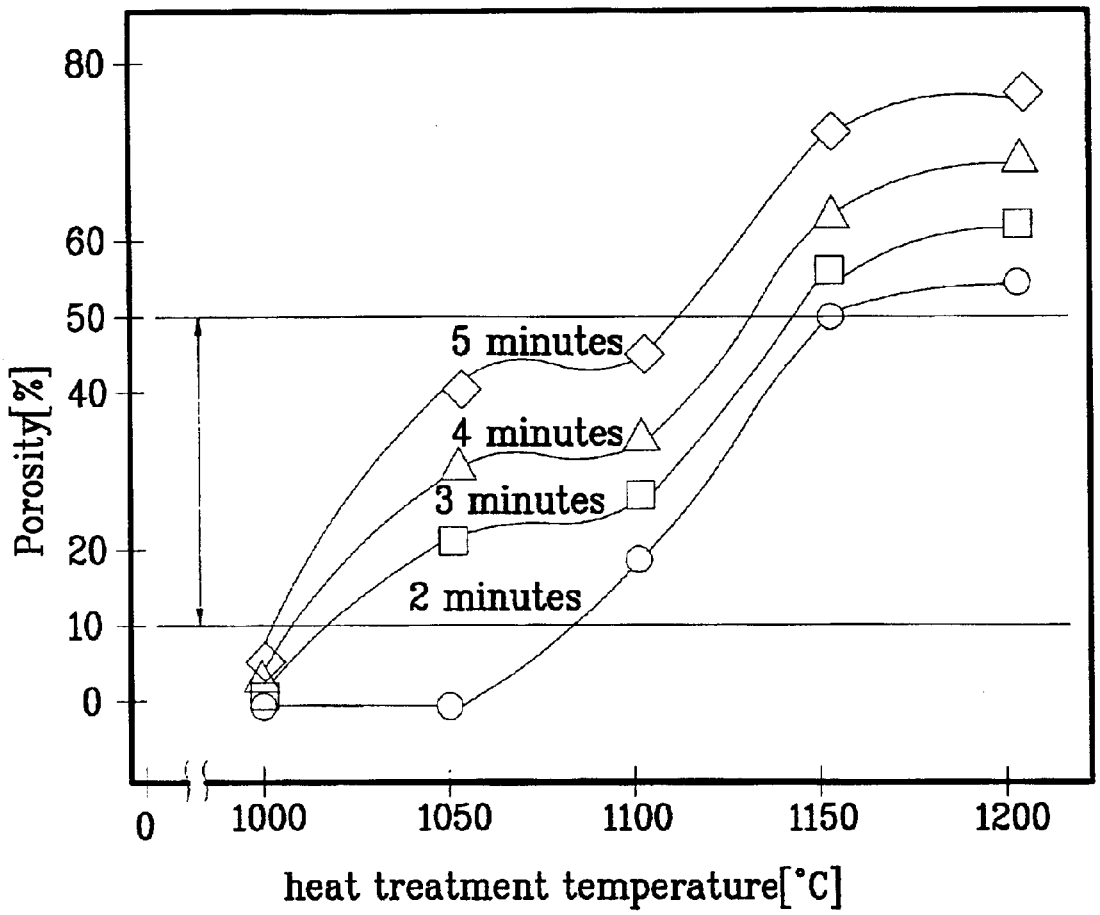

When the above materials are used, it is preferable that the heat treatment is carried out at 1050–1100° C. for 2–5 min. FIG. 6 illustrates a graph showing a porosity of a sleeve surface vs. temperature and time of heat treatment during sleeve fabrication. As illustrated in FIG. 6, when a temperature of heat treatment is higher than 1100° C., and the treatment time exceeds 5 minutes, the porosity increases to greater than 50% which causes the radiation ratio to drop and the picture presentation time lag is therefore prolonged for such porosity (as illustrated in FIGS. 4 and 5).

Additionally, the surface roughness of the porous sleeve is preferably 0.5–5.0 $\mu$m, the base metal 102, that promotes reduction of the emission layer 100, may be formed between the sleeve 110 and the emission layer, and a holder 106 for holding the sleeve 110 may be formed.

Therefore, the cathode in a CRT formed in accordance to a preferred embodiment of the present invention has the following advantages. The picture presentation time lag can be shortened, and the heater power consumption can be reduced. Additionally, a single heat treatment step can be used to fabricate the sleeve 110, which reduces the fabrication cost compared to prior art methods.

It will be apparent to those skilled in the art that various modifications and variations can be made to the cathode and method of forming the cathode of the present invention without departing from the spirit or scope of the invention. For instance, other materials could be used to form the sleeve 110, and where other materials are used, different fabrication parameters might be appropriate to give the sleeve the desired characteristics. Thus, it is intended that the present invention cover the modifications and variations of this invention provided they come within the scope of the appended claims and their equivalents.

The foregoing embodiments and advantages are merely exemplary and are not to be construed as limiting the present invention. The present teaching can be readily applied to other types of apparatuses. The description of the present invention is intended to be illustrative, and not limit the scope of the claims. Many alternatives, modifications, and variations will be apparent to those skilled in the art.

What is claimed is:

1. A cathode for a cathode ray tube (CRT), comprising:

an emission layer at an upper part of the cathode;

a sleeve on side portions of the cathode; and a heater within the cathode, wherein the sleeve contains a blackened material and has a porous surface, wherein the porous surface of the sleeve has a porosity of about 10–50%.

2. A cathode as claimed in claim 1, wherein the porous surface of the sleeve has a surface roughness of about 0.05–5.0 $\mu$m.

3. A cathode as claimed in claim 1, wherein the blackened material comprises $Cr_2O_3$.

4. A cathode as claimed in claim 1, further comprising:

a base metal formed between the sleeve and the emission layer; and a holder for supporting the sleeve.

5. A cathode ray tube comprising the cathode of claim 1.

6. A cathode for a cathode ray tube (CRT), comprising:

an emission layer at an upper part of the cathode;

a sleeve on the cathode; and, a heater within the cathode, wherein the sleeve has a porous surface, wherein the porous surface of the sleeve has a surface roughness of about 0.05–5.0 $\mu$m.

7. A cathode as claimed in claim 6, wherein the porous surface of the sleeve has a porosity of about 10–50%.

8. A cathode as claimed in claim 6, wherein the porous surface is formed by blackening a Ni—Cr alloy.

9. A cathode as claimed in claim 8, wherein Cr is diffused from the sleeve by a heat treatment in the moisturized hydrogen atmosphere.

10. A cathode as claimed in claim 6, wherein a metal surface of the sleeve is heat treated at about 1050–1100° C. for about 2–5 minutes forming said porous surface.

11. A cathode as claim in claim 6, wherein the porous surface comprises $Cr_2O_3$.

12. A cathode as claimed in claim 6, wherein the porous surface is formed by oxidizing a metal alloy of Cr into $Cr_2O_3$.

13. A cathode ray tube comprising the cathode of claim 6.

14. A cathode ray tube that includes a cathode, comprising:

a base;

a cathode mounted on a first side of the base;

a sleeve mounted on the base; and a heater mounted inside the sleeve, wherein the sleeve has an inner surface that is blackened, that has a porosity of approximately 10–50%, and that has a surface roughness of approximately 0.5–5 $\mu$m.

15. The cathode ray tube of claim 14, wherein the sleeve is formed of a nickel chromium alloy that has been heat treated in a moisturized hydrogen atmosphere.

16. A sleeve for a cathode, comprising:

a sleeve with a porous surface of about 10–50% porosity wherein the sleeve comprises an outer portion of the cathode.

17. The sleeve of claim 16, wherein said porous surface has a surface roughness of about 0.5 to 5.0 $\mu$m.

18. A cathode ray tube formed by:

forming a cathode comprising an emission layer, a heater and a sleeve;

heat treating the sleeve of the cathode to oxidize the sleeve;

vaporizing the sleeve to form pores in the surface of the sleeve; and forming a cathode ray tube comprising the cathode, wherein said sleeve has a surface roughness of about 0.5 to 5.0 $\mu$m.

* * * * *